US008577268B2

(12) United States Patent
Torimaru

(10) Patent No.: US 8,577,268 B2
(45) Date of Patent: Nov. 5, 2013

(54) IMAGE FORMING APPARATUS

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 12/962,768

(22) Filed: Dec. 8, 2010

(65) Prior Publication Data

US 2011/0142502 A1 Jun. 16, 2011

(30) Foreign Application Priority Data

Dec. 14, 2009 (JP) ..... 2009-282866

(51) Int. Cl.
*G03G 15/20* (2006.01)

(52) U.S. Cl.
USPC ..... 399/312

(58) Field of Classification Search
USPC ..... 399/312, 388, 397, 107
See application file for complete search history.

(56) References Cited

U.S. PATENT DOCUMENTS 5,923,938 A 7/1999 Enomoto et al.
7,440,720 B2 10/2008 Takehara

FOREIGN PATENT DOCUMENTS

JP 9-90770 A 4/1997
JP 10-20716 A 1/1998
JP 10020716 A * 1/1998
JP 10-142960 A 5/1998
JP 2000-10421 A 1/2000
JP 2000010421 A * 1/2000
JP 2000-233841 A 8/2000
JP 2001-356564 A 12/2001
JP 2002-91190 A 3/2002
JP 2003-241482 A 8/2003
JP 2004-144784 A 5/2004

OTHER PUBLICATIONS

Machine translation of Haneda et al.*
Machine translation of Maekawa.*
Communication dated Mar. 15, 2011, forwarding a European Search Report dated Mar. 4, 2011, in counterpart European Application No. 10194934.5-1240.
Notification of the First Office Action dated Nov. 5, 2012, in Chinese Application No. 201010594542.8.

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus comprising: an image bearing member; a conveying member; a transfer means; an attraction means, which is disposed upstream of the transfer means in a conveying direction of the transfer material, for attracting the transfer material onto the conveying member; and a winding means, which is disposed downstream of the transfer means in the conveying direction of the transfer material, for winding the conveying member, wherein a contact amount between the conveying member and the winding means corresponding to a first region where a width of the attraction means pressing the conveying member in the conveying direction is smaller than the contact amount between the conveying member and the winding means corresponding to a second region in which a width of the attraction means which presses the conveying member in the conveying direction that is smaller than the first width.

6 Claims, 13 Drawing Sheets

FIG. 8A
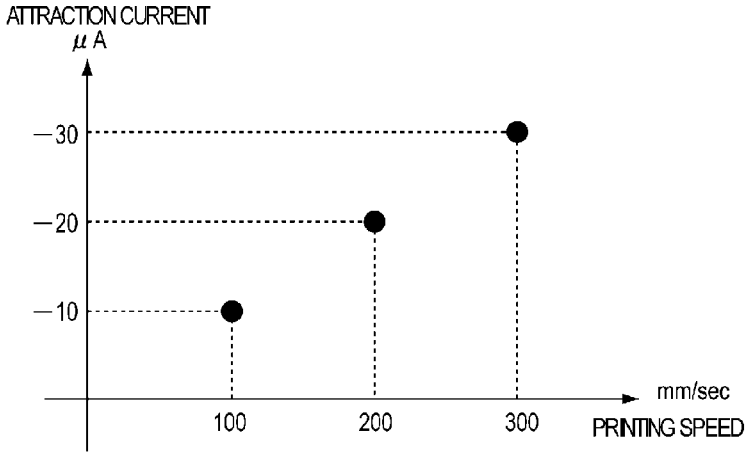
FIG. 8B
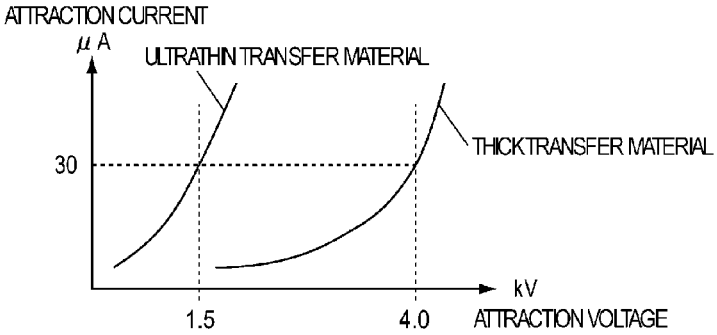
FIG. 8C
| TARGET ATTRACTION CURRENT (μA) | | PRINTING SPEED (mm/sec) | | |
|---|---|---|---|---|
| | | 100 | 200 | 300 |
| KINDS OF TRANSFER MATERIAL (g/m$^2$) | 37 ~ 52 | 10 | 20 | 30 |
| | 52 ~ 64 | 9 | 18 | 27 |
| | 64 ~ 80 | 8 | 16 | 24 |
| | ⋮ | ⋮ | ⋮ | ⋮ |
| | 200 ~ 250 | 4 | 8 | 12 |

*FIG. 11*

| TARGET ATTRACTION CURRENT ( $\mu$ A) | | ENVIRONMENT | | |
|---|---|---|---|---|
| | | N/L | N/N | H/H |
| KINDS OF TRANSFER MATERIAL ($g/m^2$) | 37 ~ 52 | 30 | 20 | 10 |
| | 52 ~ 64 | 27 | 18 | 9 |
| | 64 ~ 80 | 24 | 16 | 8 |
| | ·<br>·<br>· | ·<br>·<br>· | ·<br>·<br>· | ·<br>·<br>· |
| | 200 ~ 250 | 12 | 8 | 4 |

| | ABNORMAL IMAGE | | |
|---|---|---|---|
| | HT=(D=0.6) | HT=(D=1.0) | =(D=0.6) |
| ULTRATHIN TRANSFER MATERIAL | × | × | △ |
| THIN TRANSFER MATERIAL | × | × | △ |
| NORMAL TRANSFER MATERIAL | × | △ | ○ |
| THICK TRANSFER MATERIAL | △ | ○ | ○ |

IMAGE FORMING APPARATUS

BACKGROUND OF THE INVENTION

1. Field of the Invention

The present invention relates to an image forming apparatus such as an electrophotographic copying machine and a laser beam printer which forms a toner image on an ultrathin transfer material using chromatic color toner or black toner.

2. Description of the Related Art

A conventional image forming apparatus includes a conveying belt for bearing and conveying a transfer material between a photosensitive drum and a transfer apparatus. The conveying belt is wound around a plurality of rollers including a drive roller. The plurality of rollers rotates according to rotation of the drive roller, and the conveying belt rotates. Based on this configuration, U.S. Pat. No. 7,440,720 and Japanese Patent Application Laid-open No. 2001-356564 propose inventions having an attraction roller so that a transfer material is reliably attracted by a conveying belt.

The inventions described in U.S. Pat. No. 7,440,720 and Japanese Patent Application Laid-open No. 2001-356564 relate to an image forming apparatus in which an attraction roller is disposed on an upstream side in a conveying direction of the transfer material, and a separation roller is disposed on a downstream side in the conveying direction of the transfer material. According to the image forming apparatus described in U.S. Pat. No. 7,440,720 and Japanese Patent Application Laid-open No. 2001-356564, the transfer material is reliably attracted by the conveying belt from a position of the attraction roller to a position of the separation roller.

However, when toner has negative electric charge, positive electric charge cannot easily move from a conveying belt 724 to a transfer material 7, and an arborescent, abnormal image is prone to be generated at a position of a separation roller 726 (see FIG. 12A).

When the separation roller does not have a cross section which is uniform in a longitudinal direction thereof, e.g., when the separation roller has a crown shape as illustrated in FIG. 2A, this may cause a problem as follows. That is, an arborescent abnormal image is conspicuously generated at an edge of the transfer material in its width direction as compared with a central portion of the transfer material in its width direction. This is because that the edge of the transfer material corresponds to a place where separating timing of the transfer material is early, and greater creeping discharge (which causes the arborescent image) is generated at a place where the separating timing of the transfer material is earlier. Further, positive electric charge is increased on a surface of the transfer material at a place where the separating timing of the transfer material is early, and positive electric charge is not increased on the surface of the transfer material at a place where the separating timing of the transfer material is late. Therefore, positive electric charge on the surface of the transfer material is not uniformly electrified in the width direction of the transfer material.

When the transfer material is uniformly electrified, if electrification is possible such that it maintains a balance with the electric charge amount of a toner image, electric discharge is not generated at the separating portion and image failure is not caused. Actually, however, an image is changed in every page or job, the electric charge amount of a toner image in a width direction of a transfer material is not uniform in many cases, and it is difficult to uniformly electrify the transfer material to keep a balance with the electric charge amount of a toner image.

FIG. 12B is a table illustrating generating states of abnormal images in which a condition of halftone (HT), a condition of ultrathin transfer material, a condition of thin transfer material, a condition of normal transfer material and a condition of thick transfer material are taken into consideration. The generating states of abnormal images are evaluated based on measurement using a spectrodensitometer produced by X-Rite, Incorporated, and the generating states are determined based on the quality of the image density. In FIG. 12B, a state of an image is expressed by ○, Δ and x, wherein ○ portion excellent, Δ portion permissible but not excellent, and x portion failure. As illustrated in the leftmost column of FIG. 12B, when dot D of a halftone image is 0.6 and transfer material is ultrathin, an abnormal image is generated. When dot D of the halftone is 1.6 and transfer material is thick, an abnormal image is not generated. Image failure at a separating portion is more frequently generated when the image is of halftone, especially in the case of a highlight, and image failure is less likely in maximum image density of an engine (solid image). That is, if the design is made so that image failure is reduced in a highlight image, the image failure is reduced in all of images.

Even when an amount of toner on an entire surface of an image is uniform as illustrated in FIGS. 4A and 4C, it is difficult, in the first place, to electrify a transfer material such as to keep a complete balance with an amount of electric charge of a toner image. Even when a transfer material is uniformly electrified before a transfer material passes through a secondary transfer portion such as to keep a balance as much as possible, the transfer material is positively or negatively electrified, i.e., the transfer material is polarized positively or negatively. If a configuration at a separating portion is not uniform in its longitudinal direction, unevenness is generated in image failure at the separating portion in the transfer material in its width direction irrespective of polarity.

It is desired to provide an image forming apparatus capable of reducing image failure such as unevenness in a width direction of a transfer material that may be generated when the transfer material is separated from a transfer material conveying belt.

SUMMARY OF THE INVENTION

It is an object of the present invention to provide an image forming apparatus comprising: an image bearing member for bearing a toner image; a conveying member, which is opposed to the image bearing member, for bearing and conveying a transfer material; a transfer portion, which is opposed to the conveying member, for electrostatically transferring the toner image to the transfer material conveyed by the conveying member; an attraction portion, which is disposed upstream of the transfer portion in a conveying direction of the transfer material, for attracting the transfer material onto the conveying member; a voltage applying portion for applying a voltage to the attraction portion; and a winding portion, which is disposed downstream of the transfer portion in the conveying direction of the transfer material, for winding the conveying member, wherein a contact amount between the conveying member and the winding portion corresponding to a first region where a width of the attraction portion pressing the conveying member in the conveying direction is a first width that is smaller than the contact amount between the conveying member and the winding portion corresponding to a second region in which a width of the attraction portion which presses the conveying member in the conveying direction is a second width that is smaller than the first width.

To achieve the above and other objects, the present invention provides an image forming apparatus comprising: an image bearing member which bears a toner image; a conveying member, which is opposed to the image bearing member, for bearing and conveying a transfer material; a transfer portion, which is opposed to the conveying member, for electrostatically transferring the toner image to the transfer material conveyed by the conveying member; an attraction portion, which is disposed upstream of the transfer portion in a conveying direction of the transfer material, for attracting the transfer material onto the conveying member; a voltage applying portion for applying a voltage to the attraction portion; and a winding portion, which is disposed downstream of the transfer portion, for winding the conveying member, wherein the winding portion has such a shape that a contact amount between the conveying member and the winding portion corresponding to a first region where the attraction portion electrifies the conveying member or the transfer material by a first electrification amount is smaller than a contact amount between the conveying member and the winding portion corresponding to a second region where the attraction portion electrifies the conveying member or the transfer material by a second electrification amount which is smaller than the first electrification amount.

To achieve the above and other objects, the present invention provides an image forming apparatus comprising: an image bearing member which bears a toner image; a conveying member, which is opposed to the image bearing member, for bearing and conveying a transfer material, a transfer portion, which is opposed to the conveying member, for electrostatically transferring the toner image to the transfer material conveyed by the conveying member; an attraction portion, which is disposed upstream of the transfer portion in a conveying direction of the transfer material, for attracting the transfer material into the conveying member; a voltage applying portion for applying a voltage to the attraction portion; and a winding roller, which is disposed downstream of the transfer portion, which includes a contact portion that comes into contact with the conveying member and a non-contact portion that does not come into contact with the conveying member, for winding the conveying member, wherein a first region which is a first electrification amount in which the attraction portion electrifies the conveying member or the transfer material corresponds to the non-contact portion, and a second region which is a second electrification amount smaller than the first electrification amount in which the attraction portion electrifies the conveying member or the transfer material corresponds to the contact portion.

Further features of the present invention will become apparent from the following description of exemplary embodiments with reference to the attached drawings.

BRIEF DESCRIPTION OF THE DRAWINGS

FIGS. 8A to 8C are graphs illustrating a relation between an attraction current and a printing speed;

FIG. 11 is a table illustrating a target attraction current based on kinds of the transfer materials and a state of an environment concerning an image forming apparatus according to a fifth embodiment.

DESCRIPTION OF THE EMBODIMENTS

Embodiments of the present invention will be described in detail with reference to the drawings. Sizes, materials, shapes and relative positions of constituent parts described in the embodiments may be appropriately changed according to configurations and various conditions of the apparatus to which the invention is applied. Therefore, the scope of the invention is not limited to those.

First Embodiment

Figure 1:
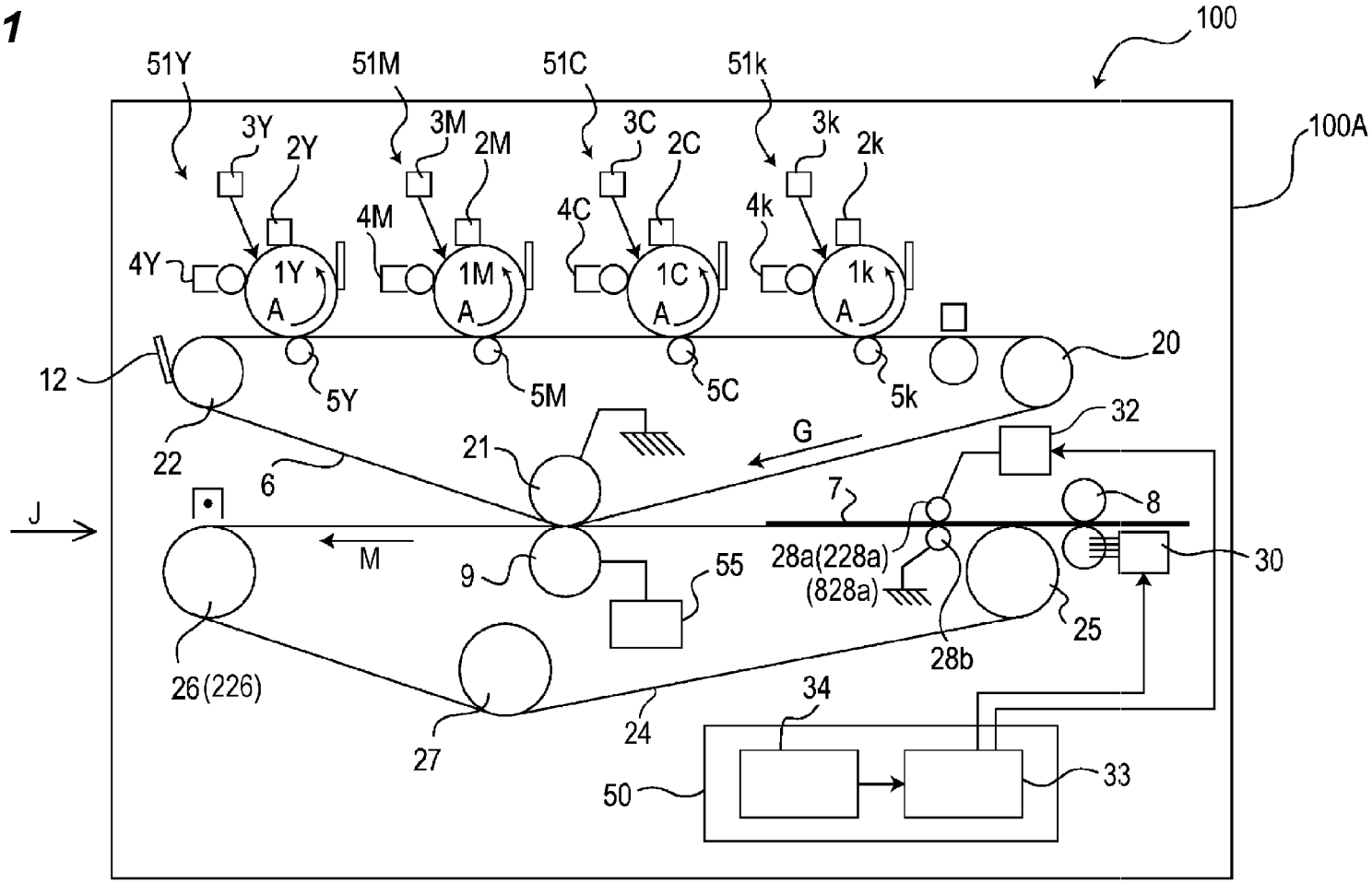
FIG. 1 is a sectional view illustrating a configuration of an image forming apparatus according to a first embodiment of the invention.

FIG. 1 is a sectional view illustrating a configuration of an image forming apparatus 100 according to a first embodiment of the present invention. The image forming apparatus 100 utilizes an electrophotographic image forming process. As illustrated in FIG. 1, the image forming apparatus 100 includes an image forming apparatus body ("apparatus body", hereinafter) 100A, and image forming units 51Y, 51M, 51C and 51*k* are provided in the apparatus body 100A. The image forming units 51Y, 51M, 51C and 51*k* include transfer rollers 5Y, 5M, 5C and 5*k*, half of each pair of rollers including photosensitive drums 1Y, 1M, 1C and 1*k*.

The photosensitive drums 1Y, 1M, 1C and 1*k* which are also known as "image bearing members" rotate in a direction of an arrow A, and the surfaces thereof are uniformly electrified by electrification apparatuses 2Y, 2M, 2C and 2*k*. Further electrification apparatuses 3Y, 3M, 3C and 3*k* expose the photosensitive drums 1Y, 1M, 1C and 1*k* based on image information. Electrostatic images corresponding to image information are formed on the photosensitive drums 1Y, 1M, 1C and 1*k* by a known electrophotographic process.

Developing apparatuses 4Y, 4M, 4C and 4*k* respectively include therein chromatic color toner, i.e., toner of yellow (Y), magenta (M), cyan (C) and black (k). The electrostatic image is developed by the developing apparatuses 4Y, 4M, 4C and 4*k*, and a toner image is formed on a surface of each of the photosensitive drums 1Y, 1M, 1C and 1*k*. A reversal development method in which toner is adhered to an exposure portion of an electrostatic image is used.

An intermediate transfer belt 6 which is also known as an "image bearing member" is disposed such that the intermediate transfer belt 6 abuts against the surfaces of the photosensitive drums 1Y, 1M, 1C and 1*k*. The intermediate transfer belt 6 is held taut by a plurality of rollers such as a tension roller 20, a secondary transfer counter roller 21 and a drive roller 22, and is rotated in a direction of an arrow G at 300 mm/s. The tension roller 20 is a roller which controls a tension of the intermediate transfer belt 6 to keep the tension at a constant value. The drive roller 22 drives the intermediate transfer belt 6. The secondary transfer counter roller 21 is a counter roller for secondary transfer. A transfer belt 24 which is also known as a "conveying member" is opposed to the intermediate transfer belt 6, it bears and conveys the transfer material 7, and it transfers a toner image of the photosensitive drum 1 onto the transfer material 7. The transfer belt 24 is kept taut around a plurality of winding rollers 25, 26 and 27, and rotated in a conveying direction M of transfer materials at 300 mm/s. A belt-cleaning apparatus 12 is disposed at a position opposite the drive roller 22 through the intermediate transfer belt 6.

The transfer material 7 is stopped once at a position of a registration roller 8. The transfer material 7 is supplied to the transfer belt 24 in synchronization with timing when a toner image on the surface of the intermediate transfer belt 6 is conveyed to a transfer nip.

An attraction roller 28*a*, as an example of an attraction portion, is disposed on a surface of the transfer belt 24. An attraction counter roller 28*b* is disposed on a back surface of the transfer belt 24. The attraction roller 28*a* and the attraction counter roller 28*b* form the nip. The transfer material 7 is conveyed toward the nip by the attraction roller 28*a* and the attraction counter roller 28*b* and nipped. The attraction roller 28*a* is connected to an attraction bias applying apparatus 32 which is an "attraction voltage applying portion". The attraction counter roller 28*b* is earthed. A current of −12 to −30 μA is applied through the attraction roller 28*a* and acts as an attraction bias which is constant-current controlled by the attraction bias applying apparatus 32. Through use of the attraction bias current, the transfer material 7 is electrostatically attracted to the transfer belt 24.

A transfer roller 9 which is also referred to as a "transfer portion" is opposite to an inner peripheral surface of the transfer belt 24, and enables the transfer of a toner image from the intermediate transfer belt 6 to the transfer material 7 conveyed by the transfer belt 24. A transfer bias applying apparatus 55 applies a transfer voltage to the transfer roller 9. If the transfer belt 24 moves in a transfer material-conveying direction M shown with arrows, the transfer material 7 passes through a secondary transfer nip formed of the secondary transfer counter roller 21 and the transfer roller 9. At that time, transfer bias which is constant-current controlled with polarity opposite that of the toner image is applied to the transfer roller 9. For example, if a current of +30 to +40 μA flows, a toner image on the surface of the intermediate transfer belt 6 is transferred to the transfer material 7. The transfer material 7 is conveyed to a separation roller 26, and the transfer material 7 is separated from the transfer belt 24. It is conveyed to a fixing apparatus (not illustrated), and receives heating, pressurizing and fixing steps of a toner image.

The intermediate transfer belt 6 and the transfer belt 24 are formed by including carbon black as an antistatic agent to resin such as polyimide and polycarbonate or various kinds of rubbers. Volume resistivity of each of the intermediate transfer belt 6 and the transfer belt 24 is set in a range of $1\times10^{9}$ to $1\times10^{14}$ Ω·cm, and thickness thereof is set in a range of 0.07 to 0.5 mm.

For example, the intermediate transfer belt 6 is formed by including an appropriate amount of carbon black into polyimide. Further, volume resistivity of the intermediate transfer belt 6 is set to $1\times10^{11}$ Ω·cm, and thickness thereof is set to 0.09 mm. The transfer belt 24 is formed by including an appropriate amount of carbon black into EPDM rubber having a thickness of 0.2 mm. PTFE is dispersed into urethane binder having thickness of 0.005 mm, and this is used as a front layer of the transfer belt 24, and volume resistivity of the transfer belt 24 is set to $1\times10^{13}$ Ω·cm.

The transfer roller 9 includes a core metal and an ion conductive foam rubber (e.g. nitrile butadiene rubber (NBR)). An outer diameter of the transfer roller 9 is 24 mm, a surface roughness of the roller is Rz=6.0 to 12.0 μm, and a resistance value is $1\times10^{5}$ to $1\times10^{7}$Ω with 2 kV application by N/N (23° C., 50% RH—relative humidity) measurement.

The attraction counter roller 28*b* is disposed inside of the transfer belt 24, and is formed of a resilient layer of ion conductive solid rubber (NBR) and core metal. An outer diameter of the attraction counter roller 28*b* is 18 mm, it has a straight shape, and a resistance value is $1\times10^{5}$ to $1\times10^{6}$Ω with 50 V application by N/N (23° C., 50% RH) measurement.

A controller 50 includes an image information control apparatus 34 and a transfer material conveyance control apparatus 33. The image information control apparatus 34 includes exposure information and information of the transfer material 7 which transfers an embodied toner image. The image information control apparatus 34 controls a driving state of the transfer material conveyance control apparatus 33 based on the obtained information. The transfer material conveyance control apparatus 33 controls driving states of the registration roller drive control apparatus 30 and the attraction bias applying apparatus 32. A basis weight of the transfer material 7 is 37 to 250 g/m$^2$.

Figure 2A:
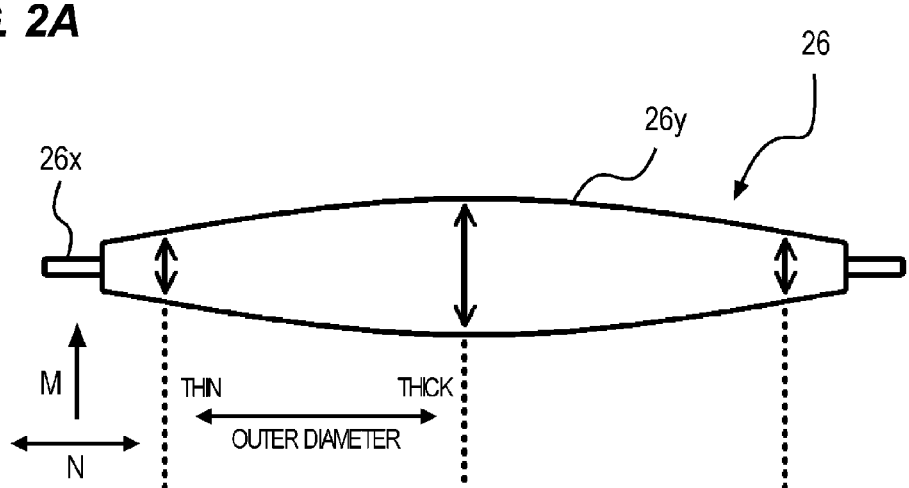
FIGS. 2A and 2B are plan views of a separation roller of the image forming apparatus of the first embodiment.

FIG. 2A is a plan view illustrating a configuration of the separation roller 26 of the image forming apparatus 100. The separation roller 26 is a winding portion having a role as a separation portion The separation roller 26 includes a rotation shaft 26*x* which is a "second rotation shaft" from which the transfer belt 24 is suspended, and a separation rotating member 26*y* which is a "second rotating member" having a varying cross-sectional area throughout its length. The separation roller 26 separates the transfer material 7 conveyed by the transfer belt 24 from the transfer belt 24. As illustrated in FIG. 2A, the separation roller 26 is formed into a regular crown shape. More specifically, the separation roller 26 is made of metal having an outer diameter of 18 mm, and formed into the regular crown shape of 1000±40 μm. That is, an outer diameter of a central portion thereof is greater than an outer diameter of an end portion thereof. As a result, concerning a contact width between the separation roller 26 and the transfer belt, wherein the contact width is a width in a direction perpendicular to the axial length of the separation roller and in the same direction as the conveying direction of the transfer medium, a contact width of the central portion is greater than a contact width of the end portion.

Figure 2B:
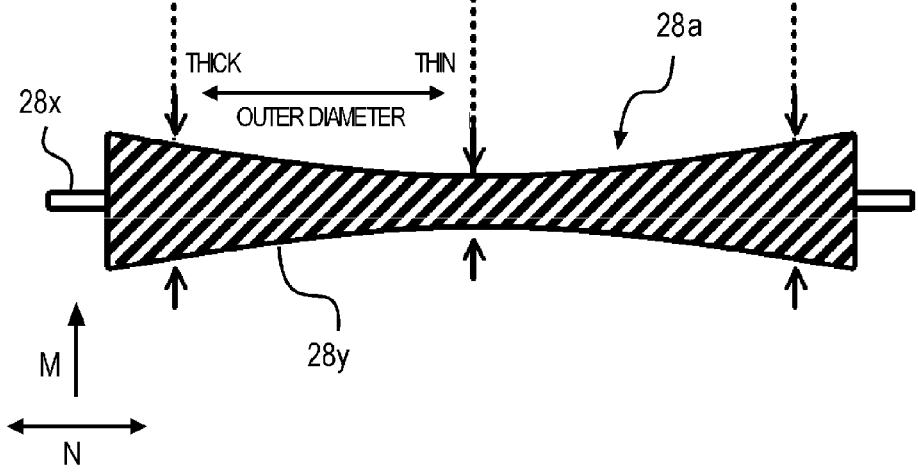

FIG. 2B is a plan view illustrating a configuration of the attraction roller 28*a* of the image forming apparatus 100. As illustrated in FIG. 2B, the attraction roller 28*a* is formed into a reversed crown shape. More specifically, the attraction roller 28*a*, as an example of an "attraction portion", has a rotation shaft 28*x* which is a "first rotation shaft", and has an attraction rotating member 28*y* which is a "first rotating member" having a varying cross-sectional area along the axial length of the roller. The attraction roller 28*a* is disposed upstream of the transfer roller 9 in the transfer material conveying direction M, and attracts the transfer material 7 onto the transfer belt 24. The attraction bias applying apparatus 32 which is a "voltage applying portion (or attraction high voltage portion)" illustrated in FIG. 1 applies an attraction high voltage to the attraction roller 28*a*. The attraction roller 28*a* electrifies the transfer material 7 with a great electrification amount (i.e. a high voltage) at a portion of the attraction rotating member 28*y* that has a diameter smaller than a corresponding portion of the separation rotating member 26*y*. More specifically, the attraction roller 28*a* reduces the electrification amount of a portion of the transfer material 7 which passes across a portion of the attraction rotating member 28*y* corresponding to a portion of the separation rotating member 26*y* where the cross-sectional area (outer diameter) is great. (The corresponding portion of the attraction rotating member is small because of the coordinated shapes of the two rollers.) Similarly, the attraction roller 28*a* increases the electrification amount of a portion of the transfer material 7 which passes through a portion of the attraction rotating member 28*y* corresponding to a portion of the separation rotating member 26*y* where the cross-sectional area (outer diameter) is small. In other words, a higher voltage is applied at the ends of the attraction rotating member 28*a* than at the centre.

That is, as can be found if FIGS. 2A and 2B are compared with each other (in the transfer material conveying direction M) a portion of the attraction rotating member 28*y* where the cross-sectional area (outer diameter) is large corresponds to a portion of the separation rotating member 26*y* where the cross-sectional area (outer diameter) is small. Further, in the transfer material conveying direction M, a portion of the attraction rotating member 28*y* where the cross-sectional area (outer diameter) is small corresponds to a portion of the separation rotating member 26*y* where the cross-sectional area (outer diameter) is large. The separation rotating member 26*y* is formed into a regular crown shape where a cross-sectional area (outer diameter) of its centre in a transfer material width direction N intersecting with the transfer material conveying direction M is larger than a cross-sectional area (outer diameter) of its end. The attraction rotating member 28*y* is formed into a reversed crown shape having a cross-sectional area (outer diameter) of the end side in the transfer material width direction N intersecting with the transfer material conveying direction M is larger than a cross-sectional area (outer diameter) at the centre. As a result, concerning a width at which the attraction roller 28*a* contacts the transfer belt 24 in the conveying direction at the time of a transfer operation, a contact width at the end becomes wider than a contact width of the central portion. Here, a first region in which the width at which the attraction roller 28*a* presses the transfer belt 24 corresponds to both ends, and a second region having a second width which is smaller than the first width at which the attraction roller 28*a* presses the transfer belt 24 corresponds to the central region. In this case, a contact amount in which the first region (both ends) of the separation roller 26 comes into contact with the transfer belt 24 is smaller than a contact amount in which the second region (central portion).

The attraction roller 28*a* is a fur brush roller. A tooth length of the brush is 5 mm, a diameter of a core metal is 8 mm, and it is formed into a reversed crown shape of 500±40 μm having a maximum outer diameter of 18 mm. A resistance value of the attraction roller 28*a* is $1\times10^5$ to $1\times10^6\Omega$ with 100 V application by N/N (23° C., 50% RH) measurement. The fur brush enters the transfer belt 24 by 1.5 to 2 mm at a maximum. When the separation roller 26 is formed into the regular crown shape, the attraction roller 28*a* is formed into the corresponding reversed crown shape.

Figure 3A:
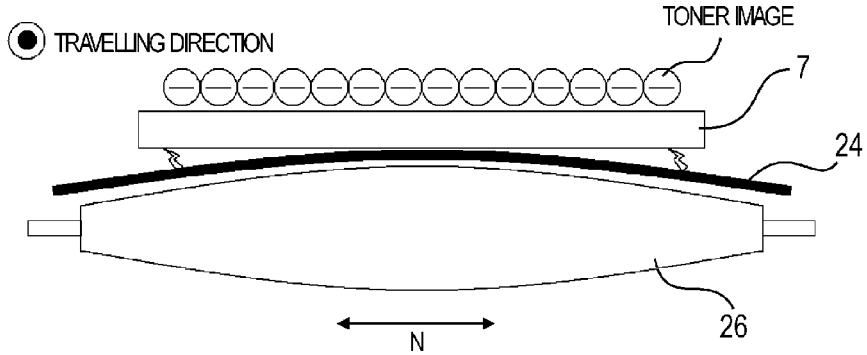
FIGS. 3A to 3D are conceptual diagrams illustrating positions of a transfer material, a transfer belt and a separation roller when there is no attraction roller, illustrating an electrification amount distribution, and illustrating states appearing immediately before the transfer material reaches the separation roller.

FIG. 3A is a conceptual diagram illustrating dispositions of the transfer material 7, the transfer belt 24 and the separation roller 26 when there is no attraction roller 28*a*, illustrating an electrification amount distribution, and illustrating a state appearing immediately before the transfer material 7 reaches the separation roller 26. FIGS. 3A, 3B, 3C and 3D are side views as viewed from a direction of an arrow J in FIG. 1. In FIG. 3A, a traveling direction of the transfer material 7 and the transfer belt 24 is a direction moving from a back surface of a sheet of FIG. 3A toward a front surface of the sheet. As illustrated in FIG. 3A, toner moves on a surface of the transfer material 7, and toner holds negative electric charge.

Figure 3B:
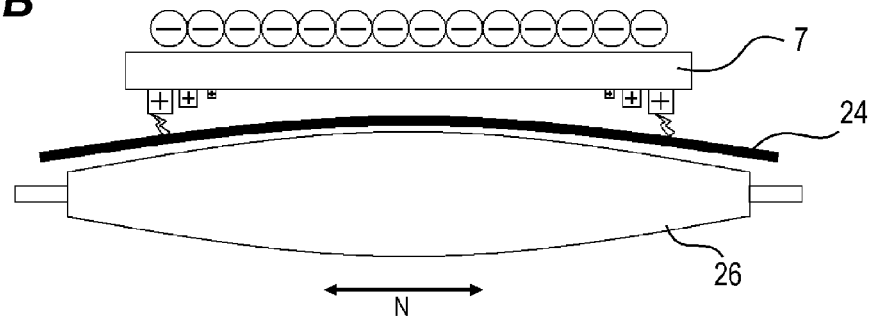

FIG. 3B is a conceptual diagram illustrating dispositions of the transfer material 7, the transfer belt 24 and the separation roller 26 when there is no attraction roller 28*a*, illustrating an electrification amount distribution, and illustrating a state appearing when the transfer material 7 reaches the separation roller 26 and is separated from the transfer belt 24. The transfer material 7 and the transfer belt 24 are in contact with each other at a central portion in the transfer material width direction N, but FIG. 3B is illustrated such that the transfer material 7 and the transfer belt 24 are separated from each other at the central portion in the transfer material width direction N so that a state of creeping discharge can easily be seen. As illustrated in FIG. 3B, the creeping discharge is generated more strongly at both ends of the transfer material 7 in the transfer material width direction N than a central portion of the transfer material 7. On the back (or separation roller-facing) surface of the transfer material 7, an amount of positive electric charge is higher as the ends of the transfer material are approached, and the amount of positive electric charge is lower as the centre of the transfer material is approached.

Figure 3C:
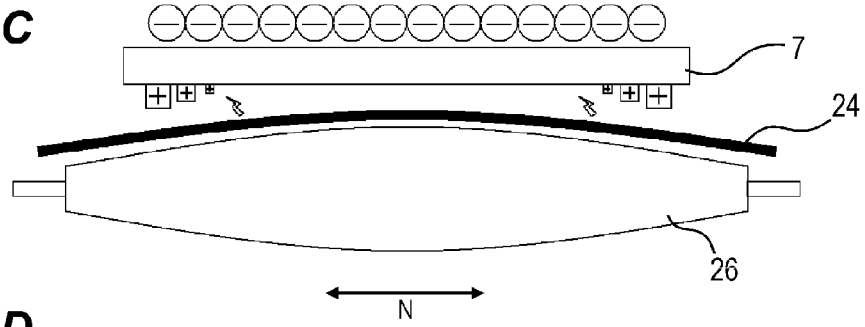

FIG. 3C is a conceptual diagram illustrating dispositions of the transfer material 7, the transfer belt 24 and the separation roller 26 when there is no attraction roller 28*a*, illustrating an electrification amount distribution, and illustrating a state where the transfer material 7 passes through the separation roller 26 and creeping discharge moves toward the central side in the transfer material width direction N. The transfer material 7 and the transfer belt 24 are in fact in contact with each other at the central portion in the transfer material width direction N, but FIG. 3C is illustrated such that the transfer material 7 and the transfer belt 24 are separated from each other at the central portion in the transfer material width direction N so that the state of creeping discharge can easily be seen. As illustrated in FIG. 3C, further creeping discharge is generated on the side of the central portion of the transfer material 7 in the transfer material width direction N. As illustrated in FIGS. 3A to 3D, a portion of the back surface of the transfer material 7 in which creeping discharge is received and the amount of positive electric charge is increased, a potential difference between the back face of the transfer material 7 and the transfer belt 24 is lowered, and the creeping discharge is subsequently reduced.

Figure 3D:
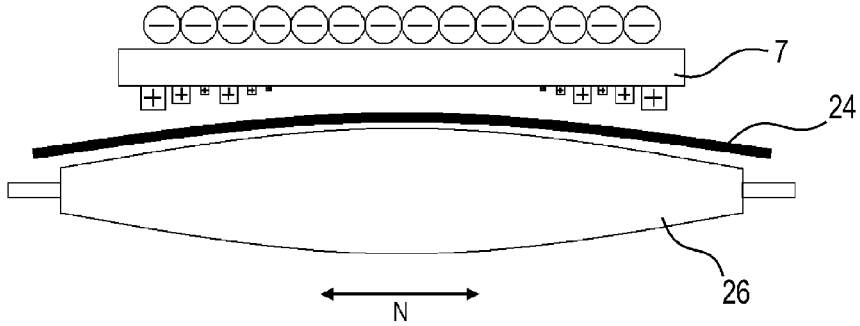

FIG. 3D is a conceptual diagram illustrating dispositions of the transfer material 7, the transfer belt 24 and the separation roller 26 when there is no attraction roller 28*a*, illustrating an electrification amount distribution, and illustrating a state where creeping discharge is not generated any more. Again, the transfer material 7 and the transfer belt 24 are in contact with each other at the central portion in the transfer material width direction N, but FIG. 3D is illustrated such that the transfer material 7 and the transfer belt 24 are separated from each other at the central portion in the transfer material width direction N so that the state of creeping discharge can easily be seen. As illustrated in FIG. 3D, although electric charge is weak, positive electric charge adheres to the central portion side of the transfer material 7 in the transfer material width direction N.

Figure 4A:
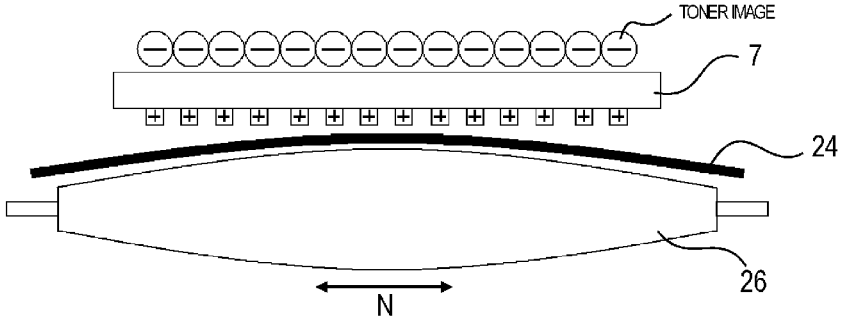
FIGS. 4A to 4D are conceptual diagrams illustrating positions of the transfer material, the transfer belt and the separation roller when the attraction roller is formed into a straight shape, illustrating an electrification amount distribution, and illustrating a case where a positive electrification amount of a back surface of the transfer material is small.

FIG. 4A is a conceptual diagram illustrating dispositions of the transfer material 7, the transfer belt 24 and the separation roller 26 when an attraction roller 828*a* is formed with a straight, uncurved surface and constant diameter), illustrating an electrification amount distribution, and illustrating a case where a positive electrification amount on the back surface of the transfer material 7 is small. FIG. 4A corresponds to a side view as viewed from the direction of the arrow J in FIG. 1. FIG. 4A illustrates a case where the attraction roller 828*a* is provisionally grounded in FIG. 1, and the attraction bias applying apparatus 32 is connected to an attraction counter roller 28*b*. The surface of the transfer material 7 is electrified with positive electric charge, and negatively charged toner rides on the surface. The transfer material 7 and the transfer belt 24 are in contact with each other at the central portion in the transfer material width direction N, but FIG. 4A is illustrated such that the transfer material 7 and the transfer belt 24 are separated from each other at the central portion in the transfer material width direction N so that the state of adhesion of electric charge can easily be seen.

When the attraction roller 828*a* is formed with a straight, uncurved face, the transfer material 7 is uniformly electrified before the transfer material 7 passes through the secondary transfer portion. The transfer material 7 is electrified such that it becomes positively or negatively charged. If the separation roller 26 is formed into a shape which does not have a uniform diameter in the longitudinal direction, no matter with which polarity the transfer material 7 is electrified, image failure on the separation roller 26 is generated with width direction unevenness in the transfer material width direction N.

Figure 4B:
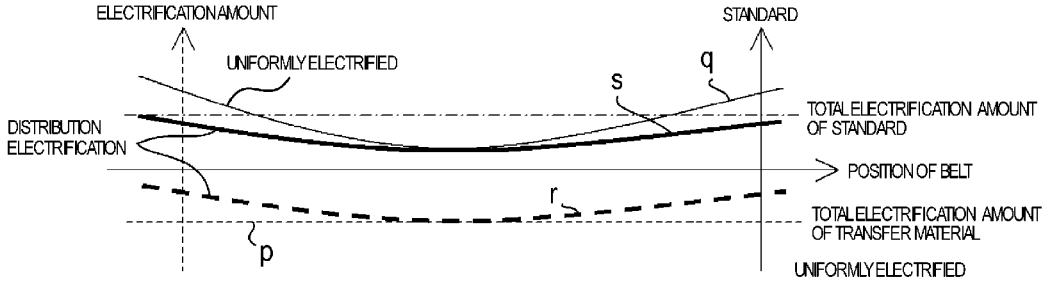

FIG. 4B is a graph illustrating a relation between an electrification amount of the transfer material 7 and a position of the transfer material in width direction N in the case of FIG. 4A. In FIG. 4B, a vertical axis indicates an electrification amount of the transfer material 7 passing through the separation roller 26 in the transfer material width direction N, and a horizontal axis indicates a position of the transfer belt 24 in the transfer material width direction N of the transfer material 7 which passes through the separation roller 26. Here, a thin broken line p is a graph illustrating a total electrification amount of the transfer material 7. A thin solid line q is a graph illustrating a distribution electrification amount of a back surface of the transfer material 7 when the back surface of the transfer material 7 is uniformly electrified. A thick broken line r is a graph illustrating a distribution electrification amount of the back surface of the transfer material 7 before the transfer material 7 passes through the separation roller 26 when both ends of the surface of the transfer material 7 in the transfer material width direction N are previously electrified. A thick solid line s is a graph illustrating a distribution electrification amount of the back surface of the transfer material 7 after the transfer material 7 passes through the separation roller 26 when both ends of the surface of the transfer material 7 in the transfer material width direction N are previously electrified.

Here, assume that the distribution electrification amount of the back surface of the transfer material 7 has such a value that the back surface of the transfer material 7 is uniformly electrified by the attraction roller 828*a* as illustrated in FIG. 4B (see the thin solid line q). At the same time, assume that the back surface of the transfer material 7 is electrified by the attraction roller 828*a* and both ends in the transfer material width direction N are strongly electrified (see the thick broken line r and the thick solid line s). In this case, when the both ends are strongly electrified, an absolute value of the electrification amount of the separation roller 26 becomes smaller than that when the transfer material 7 is uniformly electrified, and the electrification strength of the transfer material 7 becomes smaller. Utilizing the properties, as illustrated in FIG. 2B, the attraction roller 28*a* is formed into a reversed crown shape, an end of the transfer material 7 where the separating timing is earlier is more electrified with positive electric charge previously according to the regular crown shape of the separation roller 26. Therefore, width direction unevenness of image failure at the time of separation of the transfer material 7, especially thin transfer material 7 is suppressed (see the distribution electrification in FIG. 4B).

Figure 4C:
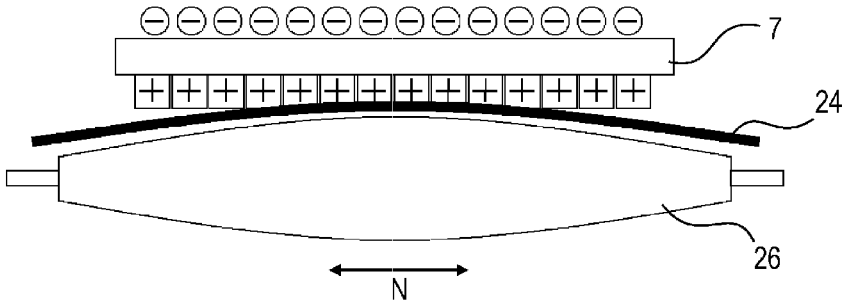
Figure 4D:
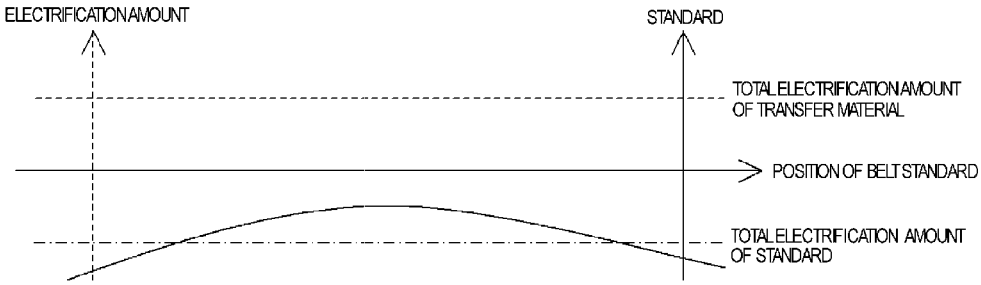

FIG. 4C is a conceptual diagram illustrating dispositions of the transfer material 7, the transfer belt 24 and the separation roller 26 when an attraction roller 828*a* is formed as a straight, constant-diameter roller. FIG. 4C illustrates an electrification amount distribution, and a case where a positive electrification amount on the back surface of the transfer material 7 is large. FIG. 4D is a graph illustrating a relation between the electrification amount of the transfer material 7 and the position in the transfer material width direction N in the case illustrated in FIG. 4C. FIG. 4C corresponds to a side view as viewed from the direction of the arrow J in FIG. 1. FIG. 4A illustrates a case where the attraction roller 828*a* is provisionally earthed in FIG. 1, and the attraction bias applying apparatus 32 is connected to an attraction counter roller 28*b*. Actually, the surface of the transfer material 7 is electrified with positive electric charge, and negatively charged toner rides on the surface. The transfer material 7 and the transfer belt 24 are in contact with each other, but FIG. 4C is illustrated such that the transfer material 7 and the transfer belt 24 are separated from each other so that the state of adhesion of electric charge can easily be seen.

As illustrated in FIG. 4C, the electrification amount on the back surface of the transfer material 7 is large in some cases. In such a case, a phenomenon occurs in which negative electric charge moves from the separation roller 26 toward the transfer material 7. For this reason, as illustrated in FIG. 4D, at the centre in the transfer material width direction N, the negative electrification amount is small, and the negative electrification amount at both ends is large. A thin solid line in FIG. 4D illustrates this fact, and this also illustrates a deterioration level of an abnormal image.

Figure 5A:
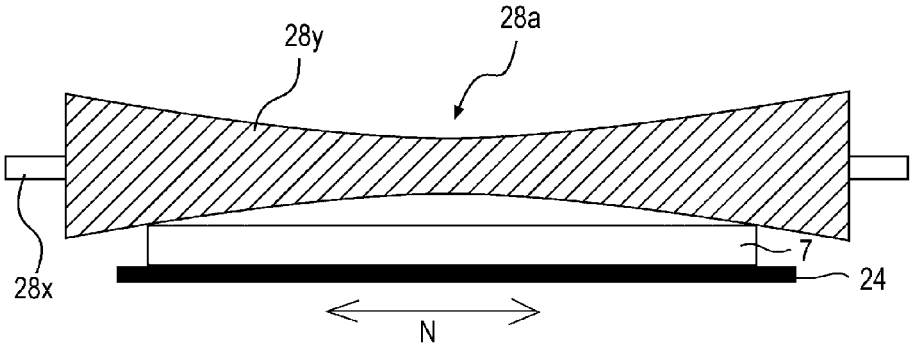
FIGS. 5A and 5B are conceptual diagrams illustrating a relation between the transfer belt, the transfer material and the attraction roller, and illustrating an electrification amount distribution of the transfer material before it passes through the attraction roller.
Figure 5B:
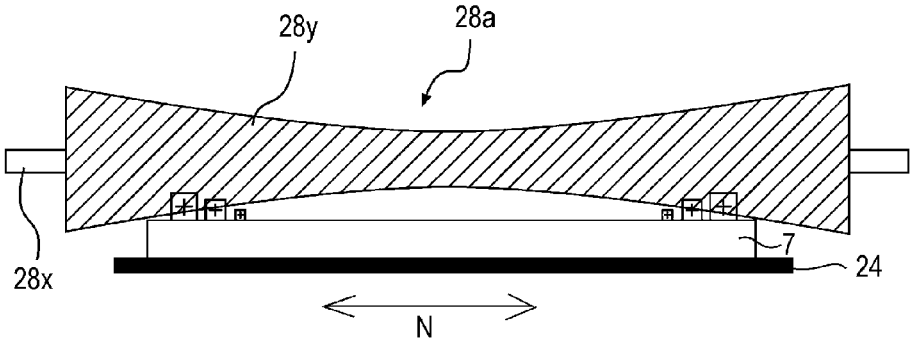

FIG. 5A is a conceptual diagram illustrating a disposition relation between the transfer belt 24, the transfer material 7 and the attraction roller 28*a*, and illustrating an electrification amount distribution of the transfer material 7 before the transfer material 7 passes the attraction roller 28*a*. FIG. 5B is a conceptual diagram illustrating the disposition relation between the transfer belt 24, the transfer material 7 and the attraction roller 28*a*, and illustrating an electrification amount distribution of the transfer material 7 after the transfer material 7 passes the attraction roller 28*a*. As illustrated in FIGS. 5A and 5B, if the transfer material 7 passes a portion below the attraction roller 28*a*, an end of the surface of the transfer material 7 in the transfer material width direction N is electrified with positive electric charge.

According to the image forming apparatus 100 of the first embodiment, when the separation roller 26 has the regular crown shape (see FIG. 2A), the attraction roller 28*a* is formed into the reversed crown shape (see FIG. 2B) such that a portion thereof in which the separating timing is earlier is more electrified. According to this configuration, image failure such as unevenness of the separating portion in the transfer material width direction N is reduced. Although the attraction roller 28*a* is a fur brush in the first embodiment, the attraction roller 28*a* may be a resilient member such as a sponge roller.

Second Embodiment

Figure 6A:
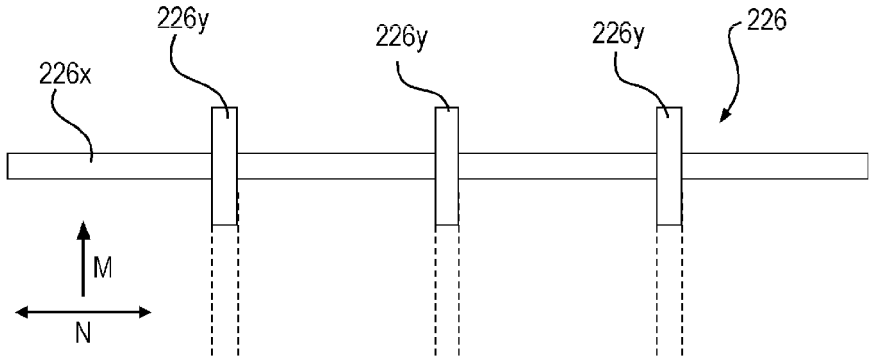
FIGS. 6A and 6B are sectional views illustrating a configuration of a separation roller of an image forming apparatus according to a second embodiment.

FIG. 6A is a plan view illustrating a configuration of a separation roller 226 in an image forming apparatus according to a second embodiment. In the image forming apparatus of the second embodiment, the same configuration and effect as those of the image forming apparatus 100 of the first embodiment will be designated with the same symbols, and description thereof will not be repeated. The separation roller 226 and an attraction roller 228*a* (see FIG. 6B) of the second embodiment are different from the separation roller 26 and the attraction roller 28*a* of the first embodiment in the following points. In a transfer material conveying direction M, a fur brush 228*y*1 (a "first resistor") is formed on a surface of an attraction rotating member 228*y* (a "first rotating member") and has a first resistance value corresponding to a contact piece 226*y* which is a portion in which a cross-sectional area (outer diameter) of a second rotating member is larger. In the transfer material conveying direction M, a sponge 228*y*2 (a "second resistor"), which is disposed on a surface of the attraction rotating member 228*y* (a "first rotating member") adjacent the fur brush 228*y*1, has a second resistance value and corresponds to a rotation shaft 226*x* which is a portion in which a cross-sectional area (outer diameter) of the second rotating member is small. The second resistance value is set lower than the first resistance value. Therefore, the sponge 228*y*2 showing a low resistance value moves more positive electric charge to the transfer material 7, and the fur brush 228*y*1 showing a high resistance value does not move as much positive electric charge to the transfer material 7.

This will be described in more detail. The second rotating member 226 includes a plurality of contact pieces 226*y* which come into contact with the transfer material 7 on the transfer belt 24. The contact pieces 226*y* are portions of the second rotating member having a larger cross-sectional area (outer diameter). The rotation shaft 226*x* is a portion of the second rotating member having a smaller cross-sectional area (outer diameter). The attraction rotating member 228*y* is formed into a columnar shape, and its curved surface has the fur brush 228*y*1 which is a "fur portion" and the sponge 228*y*2 which is a "sponge portion" in a predetermined width of the transfer material width direction N.

As illustrated in FIG. 6A, the separation roller 226 includes the rotation shaft 226*x*, and the plurality of contact pieces 226*y* which are mounted on the rotation shaft 226*x* and which come into contact with a back surface of the transfer belt 24. The contact piece 226*y* is formed in a disc shape. That is, this roller has a contact piece 226*y* which comes into contact with the transfer belt 24, and a portion 226*x* which does not come into contact with the transfer belt 24. Here, a first region which is a first electrification amount in which the attraction roller 228*a* electrifies the transfer belt 24 or the transfer material 7 corresponds to the fur brush 228*y*1, and a second region which is a second electrification amount which is smaller than the first electrification amount in which the attraction roller 228*a* electrifies the transfer belt 24 of the transfer material 7 is the sponge portion 228*y*2. In this case, a contact amount of the first region in which the separation roller 226 comes into contact with the transfer belt 24 (the fur brush) is smaller than a contact amount of the second region in which the separation roller 226 comes into contact with the transfer belt 24 (the sponge). This portion that a contact amount in which the rotation shaft 226*x* which is a non-contact portion comes into contact with the transfer belt 24 is smaller than a contact amount in which the contact piece 226*y* which is the contact portion comes into contact with the transfer belt 24. Also in below-described third and fourth embodiments, a contact amount—in which the separation roller comes into contact with the transfer belt is set small corresponding to the first region—is the first electrification amount in which the attraction roller electrifies the transfer belt. A contact amount in which the separation roller comes into contact with the transfer belt is set large corresponding to the second region is smaller than the first electrification amount in which the attraction roller electrifies the transfer belt.

Figure 6B:
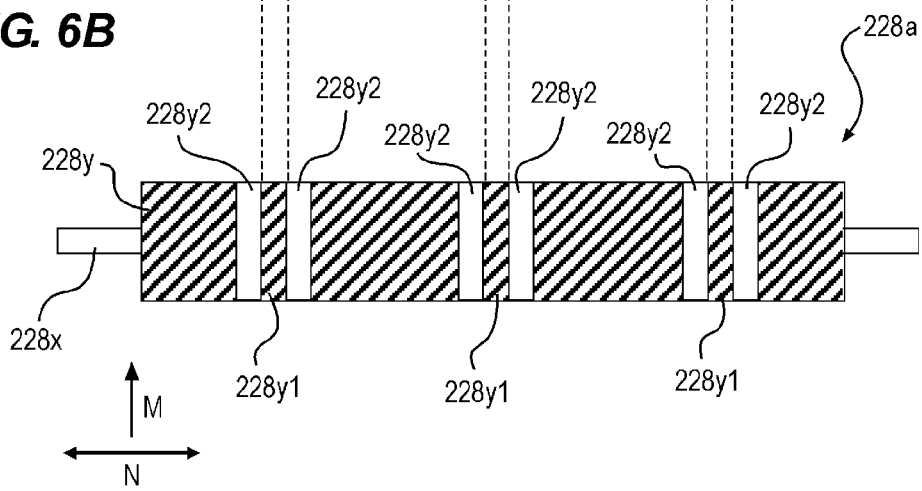

FIG. 6B is a plan view illustrating a configuration of the attraction roller 228*a* of the image forming apparatus of the second embodiment. The attraction roller 228*a* as illustrated in FIG. 6B includes a rotation shaft 228*x*, and the attraction rotating member 228*y* which is mounted on the rotation shaft 228*x* and which comes into contact with a back surface of the transfer belt 24. The attraction rotating member 228*y* is formed in a cylindrical shape. A surface of the attraction rotating member 228*y* includes, at a predetermined position in the transfer material width direction N and having a predetermined width, the fur brush 228*y*1. The fur brush 228*y*1 acts as a "contact piece corresponding portion" because it is positioned in a location on the attraction rotating member corresponding to a location of a contact piece 226*y* of the separation rotating member. The surface of the attraction rotating member 228*y* also includes the sponge 228*y*2. The sponge 228*y*2 is positioned in an "adjacent region", namely in a region of the surface adjacent to the fur brush 228*y*1. With this sponge 228*y*2, the following effect can be obtained. That is, according to a portion of the transfer material 7 where the separating timing in which the transfer material 7 is separated from the transfer belt 24 is early when passing through the separation roller 226, an electrification amount of that portion of the transfer material 7 is previously set larger material. By disposing the fur brushes 228*y*1 and the sponges 228*y*2 alternately in this manner, image failure such as longitudinal unevenness potentially generated by the separating portion is suppressed.

A rubber roller having an outer diameter of 18 mm and a resistance value of $1\times10^5$ to $1\times10^6\Omega$ with 50 V application by N/N (23° C., 50% RH) measurement is used as the attraction roller 228*a*. An outer diameter and other properties of the fur brush are the same as those of the attraction roller 28*a* of the first embodiment illustrated in FIG. 2B, but the shape of the fur brush is a straight-sided cylinder. Although the attraction roller 228*a* is formed with the fur brush 228*y*1 and the sponge 228*y*2 in the described second embodiment, various resilient members may alternatively or additionally be used.

Third Embodiment

Figure 7:
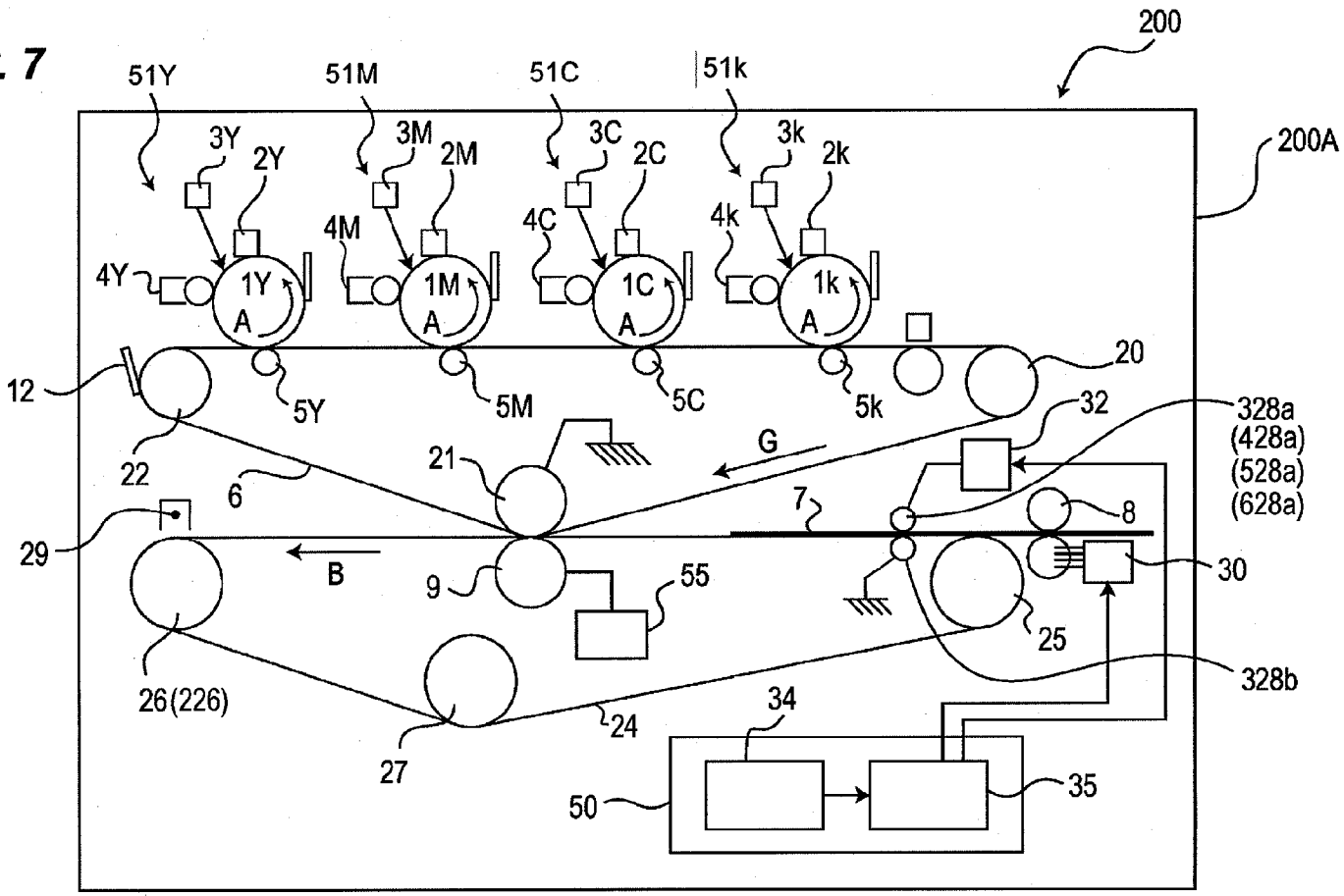
FIG. 7 is a sectional view illustrating a configuration of an image forming apparatus according to a third embodiment.

FIG. 7 is a sectional view illustrating a configuration of an image forming apparatus 200 according to a third embodiment. In the image forming apparatus 200 of the third embodiment, the same configuration as that of the image forming apparatus 100 of the first embodiment is designated with the same symbols, and description thereof will not be repeated. The configuration and effect which are peculiar to the third embodiment will be described. Inside an apparatus body 200A of the image forming apparatus 200 of the third embodiment, the intermediate transfer belt 6 is held around the plurality of rollers such as the tension roller 20, the secondary transfer counter roller 21 and the drive roller 22, and is rotated in a direction of the arrow G at 100 to 300 mm/s. The transfer belt 24 is held around the plurality of winding rollers 25, 26 and 27, and is rotated in a direction of an arrow B at 100 to 300 mm/s. A controller 50 can change rotation speeds of the intermediate transfer belt 6 and the transfer belt 24 within predetermined ranges.

A separating charger 29 which is a "diselectrifying portion" for diselectrifying electric charge on a surface of the transfer material 7 is disposed at a position opposite the separation roller 26 through the transfer belt 24. That is, the separating charger 29 is disposed at a position corresponding to the separation roller 26 and opposite a surface of the transfer belt 24. The separating charger 29 has a function to diselectrify a toner image on the surface of the transfer material 7. Therefore, if the transfer material 7 is conveyed to the separation roller 26, the separating charger 29 diselectrifies the toner image on the surface of the transfer material 7, and helps the transfer material 7 to be separated from the transfer belt 24.

An attraction roller 328*a* is disposed on the surface of the transfer belt 24, and an attraction counter roller 328*b* is disposed on the back surface of the transfer belt 24. The attraction roller 328*a* and the attraction counter roller 328*b* form a nip. The transfer material 7 is conveyed to the nip and nipped.

FIG. 8A is a graph illustrating a relation between an attraction current and a printing speed. The controller 50 adjusts an attraction voltage of the attraction bias applying apparatus 32 based on the printing speed of the transfer material 7 at which the apparatus body 200A forms a toner image on the transfer material 7 and discharges the toner image. When the transfer material 7 is nipped and conveyed, a current of −4 to −30 μA flows (as illustrated in FIG. 8B) through the attraction roller 328*a* disposed outside of the transfer belt loop 24. The value of the current is based on the printing speed of the image forming apparatus with an attraction bias which is constant-voltage being controlled by the attraction bias applying apparatus 32. Therefore, the transfer material 7 is electrostatically attracted to the transfer belt 24.

FIG. 8B is a graph illustrating a relation between an attraction current and an attraction voltage in an ultrathin transfer material and a thick transfer material. The controller 50 adjusts the attraction voltage of the attraction bias applying apparatus 32 based on the type of transfer material 7. If the type of transfer material 7 is changed, as illustrated in FIG. 8B, the controller 50 controls an applying operation of the attraction voltage such that a target attraction current flows. A user sets the type of the transfer material 7 using a touch panel (not illustrated). The controller 50 of the apparatus body 100A includes a recommendation mode concerning the setting of the printing speed (peripheral speed). For the recommendation mode, for example, the speed is 300 mm/s if a basis weight of the transfer material 7 is 37 to 100 g/m$^2$, the speed is 200 mm/s if the basis weight of the transfer material 7 is 100 to 200 g/m$^2$, and the speed is 100 mm/s if the basis weight of the transfer material 7 is 200 to 250 g/m$^2$. It is also possible that a user sets the speed through the touch panel (not illustrated).

FIG. 8C is a table illustrating a target attraction current based on the type of transfer material 7 and variation in a printing speed (peripheral speed) of the transfer material 7 of the image forming apparatus. For example, when a basis weight of a kind of the transfer material 7 is 37 to 52 g/m$^2$ and the printing speed (peripheral speed) of the transfer material 7 is 100 mm/s, the controller 50 sets the target attraction current to 10 μA. Other numeric values in the table illustrated in FIG. 8C are read in the same manner.

If the transfer belt 24 moves in the direction of the arrow B, the transfer material 7 passes through a secondary transfer nip formed by the secondary transfer counter roller 21 and the transfer roller 9 (see FIG. 7). At that time, transfer bias which is constant-current controlled with polarity opposite to that of toner image is applied to the transfer roller 9. For example, a current of +30 to +40 μA flows, and a toner image on the intermediate transfer belt 6 is transferred to the transfer material 7.

Here, the controller 50 illustrated in FIG. 7 includes the image information control apparatus 34 and a transfer material conveyance control apparatus 35. The image information control apparatus 34 includes exposure information and information of the transfer material 7 to which a toner image is transferred. A driving state of the transfer material conveyance control apparatus 35 is controlled based on the information obtained by the image information control apparatus 34, and the transfer material conveyance control apparatus 35 controls a driving state of the registration roller drive control apparatus 30 and the attraction bias applying apparatus 32 which is an "attraction bias applying portion". A material having a basis weight of 37 to 250 g/m$^2$ is used as the transfer material 7.

Figure 9A:
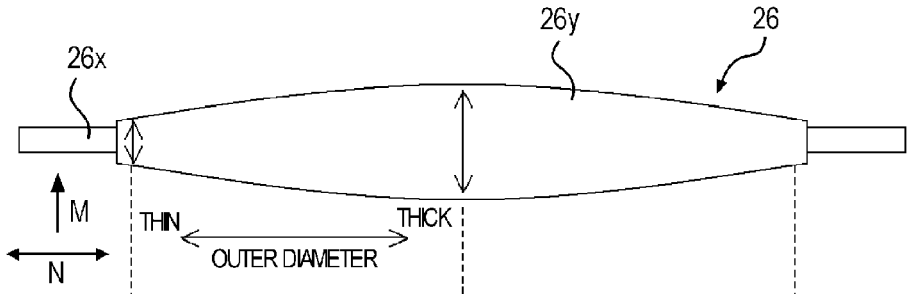
FIGS. 9A to 9C are plan views illustrating a configuration of a separation roller.

FIG. 9A is a plan view illustrating a configuration of the separation roller 26 of the image forming apparatus of the third embodiment. The separation rotating member 26*y* is formed into a regular crown shape where a cross-sectional area (outer diameter) of its central portion (in a transfer material width direction N intersecting with the transfer material conveying direction M) is larger than a cross-sectional area (outer diameter) of its ends.

Figure 9B:
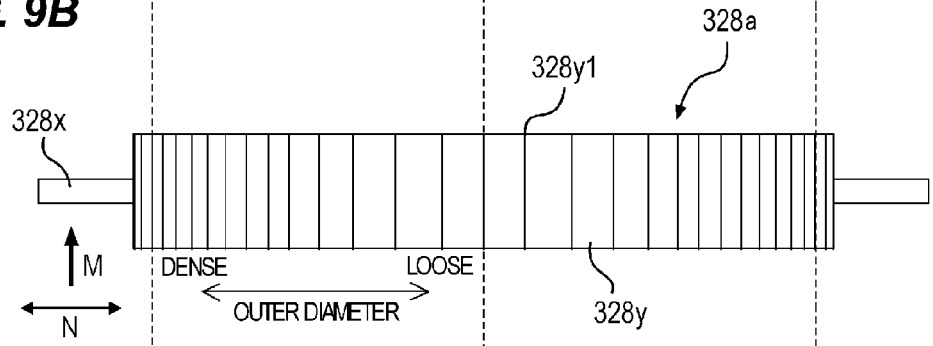

FIG. 9B is a plan view illustrating a configuration of the attraction roller 328*a* of the image forming apparatus of the third embodiment. As illustrated in FIG. 9B, the attraction roller 328*a* includes a rotation shaft 328*x* which is a "first rotation shaft", and an attraction rotating member 328*y* which is a cylindrical "first rotating member" mounted on the rotation shaft 328*x*. A plurality of annular grooves 328*y*1 having different pitches (a larger pitch on the central portion and a smaller pitch on the ends) are formed in the attraction rotating member 328*y*. The annular groove 328*y*1 having a small pitch of the attraction rotating member 328*y* corresponds to a portion of the separation rotating member 26*y* having a small cross-sectional area (outer diameter). The annular groove 328*y*1 having a large pitch of the attraction rotating member 328*y* corresponds to a portion of the separation rotating member 26*y* having a large cross-sectional area (outer diameter). The attraction roller 328*a* is a metal roller having an outer diameter of 18 mm, and the grooves are formed in the attraction roller 328*a* as described above. In the case of FIG. 9B, depth of the grooves 328*y*1 is about 50 μm, pitches of the grooves 328*y*1 are smaller as the separating timing is earlier (at the separation roller), and pitches are 50 μm to 1000 μm.

Figure 9C:
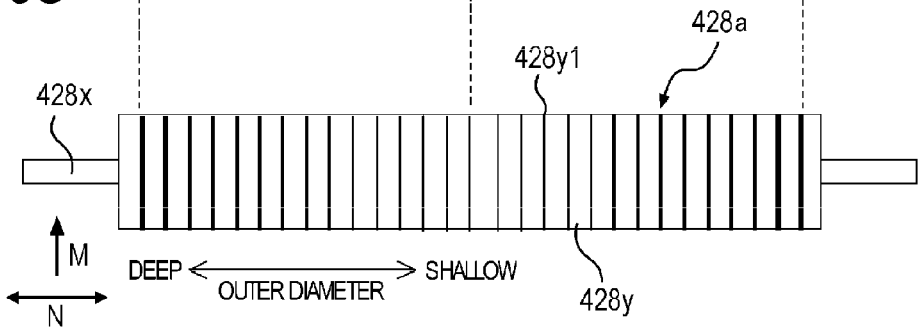

FIG. 9C is a plan view illustrating a configuration of the attraction roller 428*a*. As illustrated in FIG. 9C, the attraction roller 428*a* includes a rotation shaft 428*x* which is a "first rotation shaft" and an attraction rotating member 428*y* which is a cylindrical "first rotating member" mounted on the rotation shaft 428*x*. A plurality of annular grooves 428*y*1 having different depths (shallow on the central portion and deep on the ends) are formed in the attraction rotating member 428*y* at every position in the transfer material width direction N intersecting with the transfer material conveying direction M. A deeper annular groove of the attraction rotating member 428*y* corresponds to a portion of the separation rotating member 26*y* having a small cross-sectional area. A shallower annular groove 428*y*1 of the attraction rotating member 428*y* corresponds to a portion of the separation rotating member 26*y* having a large cross-sectional area. The attraction roller 428*a* is a metal roller having an outer diameter of 18 mm, and the grooves are formed in the attraction roller 428*a* as described above. In the case of FIG. 9C, a pitch of the grooves 428*y*1 is about 100 μm, depths of the grooves 428*y*1 are deeper as the separating timing is earlier (i.e. closer to the edges of an eventual transfer medium 7), and depths are 50 μm to 500 μm.

When the separation roller 26 has a regular crown shape (see FIG. 9A), pitches of the grooves are set more densely (see FIG. 9B) so that a portion of the metal attraction roller 428*a* where the separating timing is earlier is more electrified according to the shape of the separation roller 26. When the separation roller 26 has a regular crown shape (see FIG. 9A), depths of the grooves are alternatively or additionally set more deeply (see FIG. 9C) so that a portion of the metal attraction roller 428*a* where the separating timing is earlier is more electrified according to the shape of the separation roller 26. As a result, a risk of image failure at the separating portion is reduced. The outer diameter and the crown amount of the separation roller 26 are the same as those of the first embodiment. Although the attraction rollers 328*a* and 428*a* are made of metal in the third embodiment, attraction rollers 328*a* and 428*a* may be rigid bodies made of high rigid resin, for example.

Fourth Embodiment

Figure 10A:
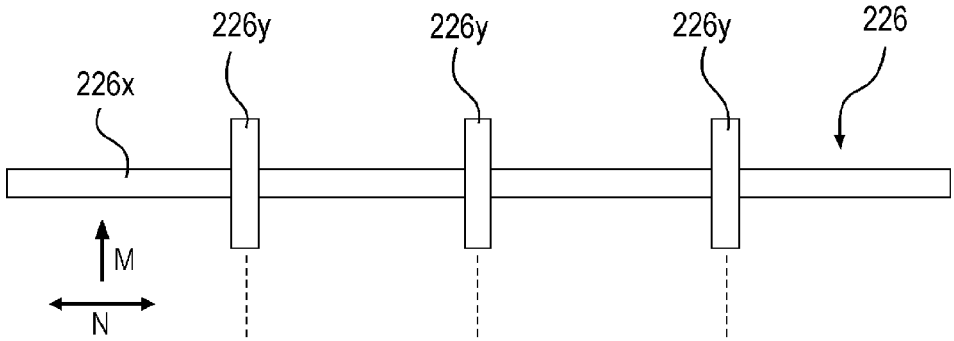
FIGS. 10A to 10C are plan views illustrating a configuration of a separation roller of an image forming apparatus according to a fourth embodiment.

FIG. 10A is a plan view of a separation roller 226 of an image forming apparatus according to a fourth embodiment. Since the separation roller 226 and an attraction roller 528*a* (see FIG. 10B) of the fourth embodiment, and a separation roller 226 and an attraction roller 628*a* of a modification of the fourth embodiment can also be applied to the image forming apparatus of the first embodiment, the same configurations are designated with the same symbols, and description thereof will not be repeated. As illustrated in FIG. 10A, the contact piece 226*y* which is a "second rotating member" includes a plurality of contact pieces 226*y* which come into contact with the transfer material 7 through the transfer belt 24. A "portion of the second rotating member having a large cross-sectional area (outer diameter)" is the contact piece 226*y*. A "portion of the second rotating member having a small cross-sectional area (outer diameter)" is a portion of the rotation shaft 226*x*. The separation roller 226 includes a rotation shaft 226*x* and a disc-like contact piece 226*y* fixed to the rotation shaft 226*x*. The separation roller 226 is made of metal. That is, this roller includes a contact piece 226*y* which comes into contact with the transfer belt, and a portion 226*x* which does not come into contact with the transfer belt.

Figure 10B:
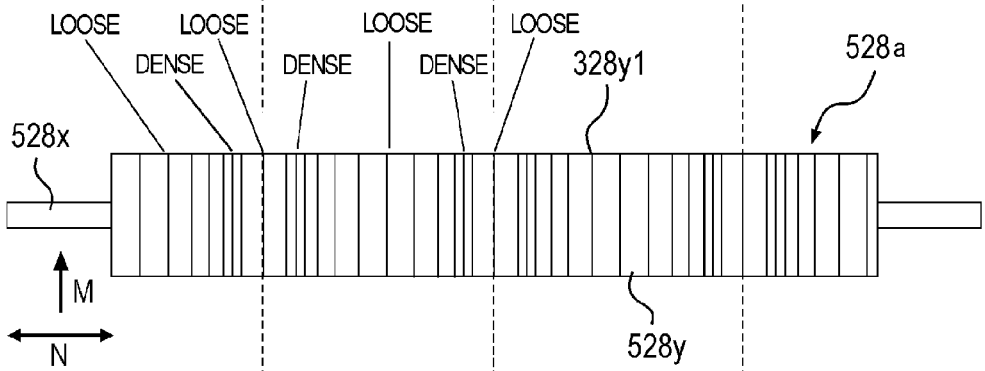

FIG. 10B is a plan view illustrating a configuration of the attraction roller 528*a* of the image forming apparatus of the fourth embodiment. As illustrated in FIG. 10B, the attraction roller 528*a* includes a rotation shaft 528*x* which is a "first rotation shaft", and an attraction rotating member 528*y* which is a cylindrical "first rotating member" mounted on the rotation shaft 528*x*. A plurality of annular grooves 328*y*1 having varying pitches (a pitch is large at a location corresponding to the contact piece 226*y*, and a pitch is small in a region adjacent the locations corresponding to the contact pieces 226*y*.) are formed in the attraction rotating member 528*y*. Annular grooves 328*y*1 having a large pitch correspond to a contact piece 226*y* which is a "portion of the second rotating member having a large cross-sectional area (outer diameter)". Annular grooves 328*y*1 having a small pitch correspond to a rotation shaft 226*x* which is a "portion of the second rotating member having a small cross-sectional area (outer diameter)". That is, the annular grooves 328*y*1 of the attraction rotating member 328*y* having the small pitch correspond to the adjacent region of the contact piece 226*y* which is a "portion of the second rotating member having a large cross-sectional area (outer diameter)". The attraction roller 528*a* includes a rotation shaft 528*x* and a cylindrical attraction rotating member 528*y* fixed to the rotation shaft 528*x*. The densely-pitched annular grooves 328*y*1 are formed on the surface of the attraction roller 528*a* such that a portion thereof associated with an earlier separating timing of the transfer material 7 is more electrified according to the shape of the separation roller 226. According to this configuration, image failure at the separating portion is reduced. The separation roller 226 having an outer diameter of 18 mm, and a core metal outer diameter of 10 mm is used. The material of the attraction roller 528*a* is metal, but the attraction roller 528*a* may be a rigid body made of rigid resin.

Figure 10C:
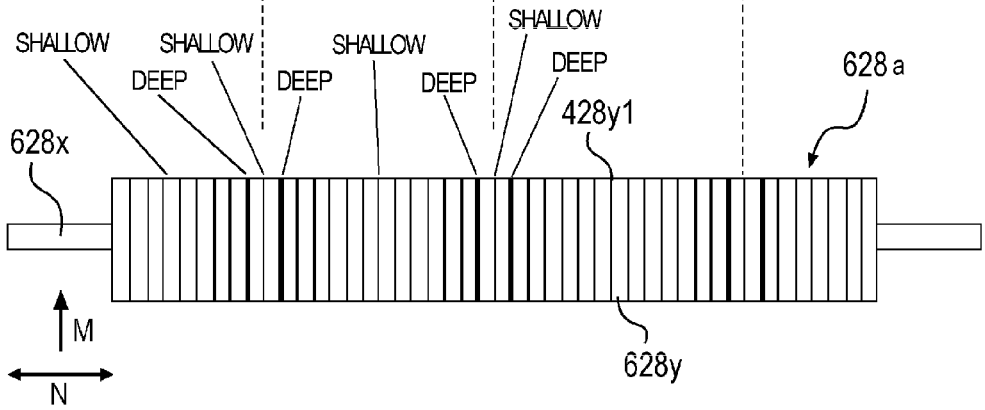
Figures 12A, 12B:
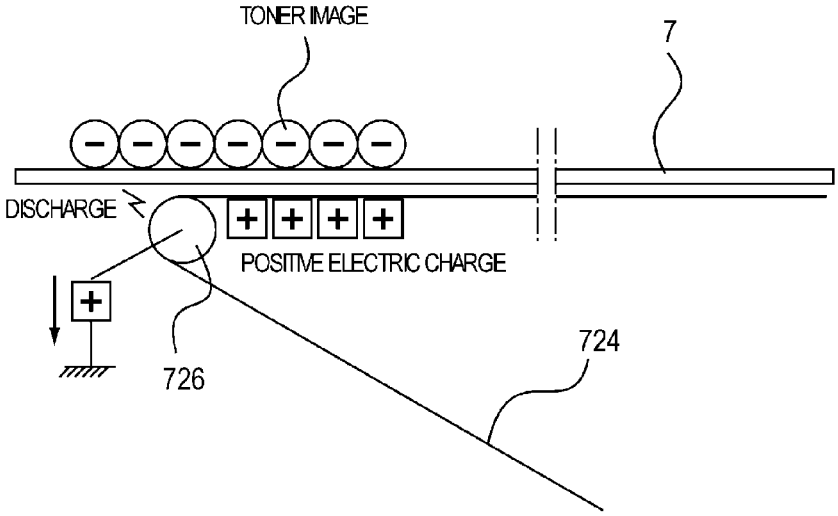
FIG. 12A PRIOR ART
FIG. 12B PRIOR ART
FIGS. 12A and 12B are schematic diagrams illustrating steps in which a conventional separation roller separates a transfer material from a transfer belt.

FIG. 10C is a plan view illustrating an alternative configuration of the attraction roller 628*a*. As illustrated in FIG. 10C, the attraction roller 628*a* includes a rotation shaft 628*x* which is a "first rotation shaft", and an attraction rotating member 628*y* which is a cylindrical "first rotating member" mounted on the rotation shaft 628*x*. A plurality of annular grooves 428*y*1 having different depths (shallow on a position corresponding to the contact piece 226*y* and deep in a region adjacent to the position corresponding to the contact pieces) are formed in the attraction rotating member 628*y* in the transfer material width direction N intersecting with the transfer material conveying direction M. A shallower annular groove 428*y*1 of the attraction rotating member 428*y* corresponds to the contact piece 226*y* which is a "portion of the second rotating member having a large cross-sectional area (outer diameter)". A deeper annular groove 428*y*1 of the attraction rotating member 428*y* is included in and corresponds to the rotation shaft 226*x* which is a "portion of the second rotating member having a small cross-sectional area (outer diameter)" in a predetermined width. That is, the deep annular groove 428*y*1 of the attraction rotating member 428*y* corresponds to the region adjacent the contact piece 226*y*. The attraction roller 628*a* includes a rotation shaft 628*x* and a cylindrical attraction rotating member 628*y* fixed to the rotation shaft 628*x*. Annular deep grooves 428*y*1 are formed on a surface of the attraction roller 628*a* such that a location thereof where the separating timing of the transfer material 7 is earlier, more electrification is carried out according to a shape of the separation roller 226. According to this configuration, image failure at the separating portion is reduced. The separation roller 226 having an outer diameter of 18 mm, and a core metal outer diameter of 10 mm is used. The material of the attraction roller 628*a* is metal, but the attraction roller 628*a* may be made of rigid resin.

Fifth Embodiment

FIG. 11 is a table illustrating a target attraction current based on types of transfer material 7 and a state of environment according to the image forming apparatus. In the image forming apparatus of the fifth embodiment, the same configurations as those of the image forming apparatus 100 of the first embodiment are designated with the same symbols, and description thereof will not be repeated. The image forming apparatus of the fifth embodiment is different from the image forming apparatus 100 of the first embodiment in the following point. That is, the controller 50 adjusts an attraction high voltage of the attraction bias applying apparatus 32 based on at least one of a temperature and humidity in the apparatus body 100A.

In the table of the target attraction current in each environment illustrated in FIG. 11, i.e., temperature and humidity, the environment is as follows: Normal/Low: N/L (23° C., 5% RH), Normal/Normal: N/N (23° C., 50% RH), and High/High: H/H (30° C., 80% RH). The target attraction current is changed based on the environment and kinds of the transfer material 7.

For example, when the type of transfer material 7 has a basis weight of 37 to 52 g/m$^2$ and the environment state is N/L (23° C., 5% RH), the controller 50 sets the target attraction current to 30 μA. Other numeric values in the table illustrated in FIG. 11 are handled in the same manner.

Generally, since image failure caused by discharge is prone to be generated in low humidity environment, a target attraction current of N/L (23° C., 5% RH) which is the low humidity environment is set high in the fifth embodiment also, and the target attraction current of H/H (30° C., 80% RH) which is high humidity environment is set low.

A user sets the type of transfer material 7 using a touch panel (not illustrated), and temperature and humidity are set by a temperature and humidity sensor provided in the body (not illustrated).

As described above, when the separation roller 26 has the regular crown shape as illustrated in FIG. 2A, the reversed crown shape is employed for the attraction roller so that a location where the separating timing is earlier at the separation roller 26 is more electrified at the attraction roller 28*a* as illustrated in FIG. 2B. According to this configuration, longitudinal unevenness of an image at the separating portion can be reduced, and optimization can be carried out by controlling the target attraction current at the attraction roller 28*a* according to the environment and the type of transfer material 7. The attraction roller 28*a* may be a fur brush or a resilient member such as a sponge roller.

According to the image forming apparatuses of the first to fifth embodiments, the attraction portion electrifies the transfer material with a large electrification amount using the first rotating member at a position corresponding to where the cross-sectional area of the second rotating member is small. Further, the transfer material is electrified with a small electrification amount using the first rotating member at a position corresponding to where the second rotating member has a large cross-sectional area (diameter). Therefore, a portion of the transfer material susceptible to creeping discharge when the transfer material is separated from a conveying member has its susceptibility reduced by being previously electrified corresponding to a shape of the separating portion. As a result, creeping discharge generated when the transfer material is separated from the conveying member is suppressed, and image failure such as unevenness in the transferred image in the transfer material width direction (the width direction being defined as being a direction that intersects with the transfer material conveying direction) is suppressed.

According to the image forming apparatus of the first embodiment, a portion of the attraction rotating member 28*y* having a large cross-sectional area (outer diameter) corresponds to a portion of the separation rotating member 26*y* having a small cross-sectional area. Therefore, an electrification amount of a portion of the transfer material 7 corresponding to a portion of the attraction rotating member 28*y* having a large cross-sectional area (outer diameter) is previously increased, and a phenomenon in which an electrification amount is increased when the transfer material 7 passes through a portion of the separation rotating member 26*y* having a small cross-sectional area (outer diameter) is suppressed.

According to the image forming apparatus of the first embodiment, if the separation roller 26 is formed into the regular crown shape, the transfer material 7 separates from an edge of the transfer belt 24 in the transfer material width direction N and creeping discharge is easily generated. On the other hand, if the attraction roller 28*a* is formed into the reversed crown shape, the attraction roller 28*a* electrifies the edge of the transfer material 7 in the transfer material width direction N with a larger electrification amount. As a result, since electric charge is already accumulated on the edge of the transfer material 7, creeping discharge in which electric charge moves from the transfer belt 24 toward the transfer material 7 is suppressed when the transfer material 7 is separated from the separation roller 26.

According to the image forming apparatus of the second embodiment, since a resistance value of the sponge 228*y*2 is low, electric charge is more likely to move from the sponge 228*y*2 toward the transfer material 7. On the other hand, a resistance value of the fur brush 228*y*1 is high and so electric charge does not as easily move from the fur brush 228*y*1 toward the transfer material 7. The position of the sponge 228*y*2 of the attraction rotating member 228*y* corresponds to the position of the exposed rotation shaft 226*x* of the separation rotating member 26, the exposed portion of shaft being referred to herein as a "portion of the second rotating member having a small cross-sectional area (outer diameter)". Therefore, the electrification amount of a portion of the transfer material 7 which passes over the sponge 228*y*2, and a phenomenon in which the electrification amount is increased when the transfer material 7 passes through the separation roller 226, is suppressed.

According to the image forming apparatus of the second embodiment, if the separation roller 226 is formed of the rotation shaft 226*x* and the plurality of contact pieces 226*y*, the transfer material 7 is separated from the portions adjacent the plurality of contact pieces 226*y* and the creeping discharge is easily generated. To overcome this creeping discharge, the attraction roller 228*b* is formed of the fur brush 228*y*1 and the sponge 228*y*2, and a contact portion of the sponge 228*y*2 in the transfer material 7 is electrified with a larger electrification amount than other portions of the transfer material. As a result, since electric charge is already accumulated in the transfer material 7 at the portion contacting the sponge 228*y*2, a phenomenon in which electric charge moves from the transfer belt 24 toward the transfer material 7 when the transfer material 7 is separated from the transfer belt using the separation roller 226 is suppressed.

According to the image forming apparatuses of the third and fourth embodiments, electric charge moves from the annular groove 328*y*1 toward the transfer material 7. At portions of the attraction rotating members 328*y* and 528*y* where the pitches of the annular grooves 328*y*1 are small, the number of annular grooves 328*y*1 provided per a unit length in the transfer material width direction N is higher than at portions of the attraction rotating members 328*y* and 528*y* where the pitches of the annular grooves 328*y*1 are large. Therefore, the electrification amount of the portion of the transfer material 7 corresponding to the portions of the attraction rotating members 328*y* and 528*y* where the number of annular grooves

328*y*1 is high is increased, and the phenomenon in which the electrification amount is increased when the transfer material 7 passes over the separation roller 26 or 226 is suppressed.

According to the image forming apparatuses of the third and fourth embodiments, electric charge moves from the annular groove 428*y*1 toward the transfer material 7. At a portion of the attraction rotating member 428*y* having a deep annular groove 428*y*1, strength of the electric charge moving toward the transfer material 7 is greater than that at a portion of the attraction rotating member 428*y* or 628*y* having a shallower annular groove 428*y*1. Therefore, the electrification amount of the portion of the transfer material 7 corresponding to the portions of the attraction rotating members 428*y* or 628*y* where the annular groove 428*y*1 is deep is increased, and the phenomenon in which the electrification amount is increased when the transfer material 7 passes over the separation roller 26 or 226 is suppressed.

According to the image forming apparatus of the fifth embodiment, the driving state of the attraction bias applying apparatus 32 is controlled and in addition to this, the driving state of the separating charger 29 is also controlled, and image failure such as unevenness in the image in the transfer material width direction N when a thin transfer material 7 is separated is further suppressed.

According to the image forming apparatus of the fifth embodiment, since the attraction voltage is controlled according to kinds of the transfer material 7, image failure such as unevenness in the image in the transfer material width direction N when the transfer material 7 is separated depending on differences in kinds of the transfer material 7 is suppressed.

According to the image forming apparatus of the fifth embodiment, since the attraction voltage is controlled according to a printing speed of the transfer material 7, image failure such as unevenness in the image in the transfer material width direction N when the transfer material 7 is separated depending on differences in a printing speed of the transfer material 7 is suppressed.

According to the image forming apparatus of the fifth embodiment, since the attraction high voltage is controlled according to environment such as temperature and humidity, image failure such as unevenness in the image in the transfer material width direction N which may be generated when the transfer material 7 is separated from the transfer belt 24 depending on differences in temperature or humidity is suppressed.

In each of the embodiments, the image forming apparatus in which the intermediate transfer belt 6 as the "image bearing member" is interposed is described, but the invention is not limited to this configuration. That is, it is possible to employ a transfer type image forming apparatus in which the transfer belt 24 which is the "conveying member" is disposed such as to be opposed to the photosensitive drums 1Y to 1*k* as the "image bearing members".

The "attraction portion" is the resilient member in the first and second embodiments, and the rigid body member in the third and fourth embodiments, but the invention is not limited to this configuration. In the image forming apparatus, the "attraction portion" may be the rigid body member in the first and second embodiments, and the resilient member in the third and fourth embodiments.

According to the present invention, the attraction portion electrifies the transfer material with a large electrification amount at a portion of the corresponding first rotating member in the transfer material conveying direction at a portion of the second rotating member having a small cross-sectional area. Further, the transfer material is electrified with a small electrification amount at a portion of the corresponding first rotating member in the transfer material conveying direction M at a portion of the second rotating member having a large cross-sectional area. Therefore, the transfer material is previously electrified corresponding to a shape of the separating portion at a portion thereof where creeping discharge is easily generated when the transfer material is separated from a conveying member. As a result, creeping discharge which is generated when the transfer material is separated from the conveying member is suppressed, and image failure such as unevenness in the transfer material width direction N intersecting with the transfer material conveying direction M is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-282866, filed Dec. 14, 2009, which is hereby incorporated by reference herein in its entirety.

What is claimed is:

1. An image forming apparatus comprising:

an image bearing member for bearing a toner image;

a conveying belt, which is opposed to the image bearing member, for bearing and conveying a transfer material;

a transfer portion, which is opposed to the conveying belt, for electrostatically transferring the toner image to the transfer material conveyed by the conveying belt;

an attraction roller, configured to electrostatically charge the transfer material to be attracted to the conveying belt and to be disposed upstream of the transfer portion in a conveying direction of the transfer material, and to have an outer diameter on a central section which is smaller than an outer diameter on an end section in the width direction which intersects with the conveying direction;

a voltage applying portion configured to apply a voltage to the attraction roller; and a winding roller, configured to be disposed adjacent and downstream of the transfer portion in the conveying direction of the transfer material, to wind the conveying belt, and to have an outer diameter on a central section which is larger than an outer diameter on an end section in the width direction which intersects with the conveying direction, wherein a contact amount between the attraction roller and the conveying belt on the end section is larger than a contact amount between the attraction roller and the conveying belt on the central section, and wherein a contact amount between the winding roller and the conveying belt on the end section is smaller than a contact amount between the winding roller and the conveying belt on the central section.

2. The image forming apparatus according to claim 1, wherein a discharger which discharges an electric charge on a surface of the transfer material is disposed at a position opposed to the winding roller through the conveying belt.

3. The image forming apparatus according to of claim 1, further comprising a controller which adjusts an attraction high voltage of the voltage applying portion based on kinds of the transfer material.

4. An image forming apparatus comprising:

an image bearing member for bearing a toner image;

a conveying belt, which is opposed to the image bearing member, for bearing and conveying a transfer material;

a transfer portion, which is opposed to the conveying belt, for electrostatically transferring the toner image to the transfer material conveyed by the conveying belt;

an attraction roller, configured configured to electrostatically charge the transfer material to be attracted to the conveying belt and to be disposed upstream of the transfer portion in a conveying direction of the transfer material, and to have an outer diameter on a central section which is smaller than an outer diameter on an end section in the width direction which intersects with the conveying direction;

a voltage applying portion configured to apply a voltage to the attraction roller; and a winding roller, configured to be disposed adjacent and downstream of the transfer portion in the conveying direction of the transfer material, to wind the conveying belt, and to have an outer diameter on a central section which is larger than an outer diameter on an end section in the width direction which intersects with the conveying direction, wherein a charge amount of the attraction roller to the transfer material on the conveying belt on the end section is larger than a charge amount of the attraction roller to the transfer material on the conveying belt on the central section, and wherein a contact amount between the winding roller and the conveying belt on the end section is smaller than a contact amount between the winding roller and the conveying belt on the central section.

5. The image forming apparatus according to claim 4, wherein a discharger which discharges an electric charge on a surface of the transfer material is disposed at a position opposed to the winding roller through the conveying belt.

6. The image forming apparatus according to claim 4, further comprising a controller which adjusts an attraction high voltage of the voltage applying portion based on kinds of the transfer material.

* * * * *